US007020905B2

(12) United States Patent
Chiang

(10) Patent No.: US 7,020,905 B2
(45) Date of Patent: Apr. 4, 2006

(54) SWIMMING GOGGLE

(76) Inventor: Herman Chiang, 11F-2 No. 634-9 Ching-Ping RD., Chung-Ho City, Taipei Hsien (TW)

( * ) Notice: Subject to any disclaimer, the term of this patent is extended or adjusted under 35 U.S.C. 154(b) by 138 days.

(21) Appl. No.: 10/758,196

(22) Filed: Jan. 16, 2004

(65) Prior Publication Data

US 2005/0155139 A1 Jul. 21, 2005

(51) Int. Cl.
*A61F 9/02* (2006.01)

(52) U.S. Cl. ..... 2/448; 2/452

(58) Field of Classification Search ..... 2/448–450, 2/440

See application file for complete search history.

(56) References Cited

U.S. PATENT DOCUMENTS 6,349,420 B1 * 2/2002 Chiang ..... 2/428
6,405,384 B1 * 6/2002 Chiang ..... 2/428
6,694,533 B1 * 2/2004 Chiang ..... 2/428
6,832,394 B1 * 12/2004 Chiang ..... 2/428

* cited by examiner

*Primary Examiner*—Katherine M. Moran
(74) *Attorney, Agent, or Firm*—Troxell Law Office, PLLC

(57) ABSTRACT

A swimming goggle have a left and a right frames respectively accommodating eyeglasses therein, a nose support, head fasteners, and adjusting apparatuses for adjusting head fasteners. The nose support connects the left frame with the right frame. The head fasteners respectively connect with outward sides of the left and right frames. Each adjusting apparatus has a biasing arm, operating buttons and a flexible arcuate plate assembled together. The biasing arm abuts against a corresponding stopping slot in a head fastener and is controllable by the operating buttons. The biasing arm engages or disengages the stopping slot to allow moving of the head fastener through operations of the operating buttons. Namely, the operating buttons are operated such that the biasing arms engage/disengage the stopping slots of the head fasteners. A user can easily presses the operating buttons to adjust the head fasteners by means of operation of operating buttons.

11 Claims, 6 Drawing Sheets

6—6

SWIMMING GOGGLE

BACKGROUND OF THE INVENTION

1. Filed of the Invention

The present invention relates to swimming goggle, and particularly to swimming goggle which have easily-adjustable head fasteners and are more conveniently used.

2. Related Art

It is rather inconvenient to adjust head fasteners of conventional swimming goggle in use. Conventional swimming goggle provide adjusting buttons for positioning and adjusting the head fasteners. Each adjusting button defines a pair of holes through which the head fasteners are pulled for positioning. In use the head fasteners cannot be adjusted, so the swimming goggle have to be taken down for adjusting the head fasteners. Moreover, the head fasteners are usually adjusted by users' feeling. Thus, the head fasteners are uneasily adjusted to a desired position in such an adjusting way, whereby it is very troublesome to adjust head fasteners.

SUMMARY OF THE INVENTION

Accordingly, an object of the present invention is to provide swimming goggle which are adjusted and positioned easily even in use and are inching-adjustable.

The swimming goggle comprise adjusting apparatuses at outward sides thereof for fastening head fasteners to a left and a right frames. Each adjusting apparatus comprises a biasing arm, operating buttons and a flexible arcuate plate. The biasing arm abuts against a corresponding stopping slot in a head fastener and is controllable by the operating buttons. The biasing arm engages or disengages the stopping slot to allow moving of the head fastener through operations of the operating buttons, wherein the flexible arcuate plate provides return force for the operating button by the means of flexibility thereof. Thus, the biasing arms engage stopping slots of the head fasteners such that the head fasteners move in a single direction when the operating buttons are free; the biasing arms disengage stopping slots of the head fasteners such that the head fasteners move freely through the inlets and the outlets when the operating buttons are pressed, so as to a user can easily adjust the head fasteners by operation of the operating buttons and without taking down the swimming goggle.

According to the above mentioned of the present invention, wherein the operating buttons are distributed substantially symmetric about the biasing arm for easily controlling the biasing arm.

DESCRIPTION OF THE PREFERRED EMBODIMENTS

Figure 1:
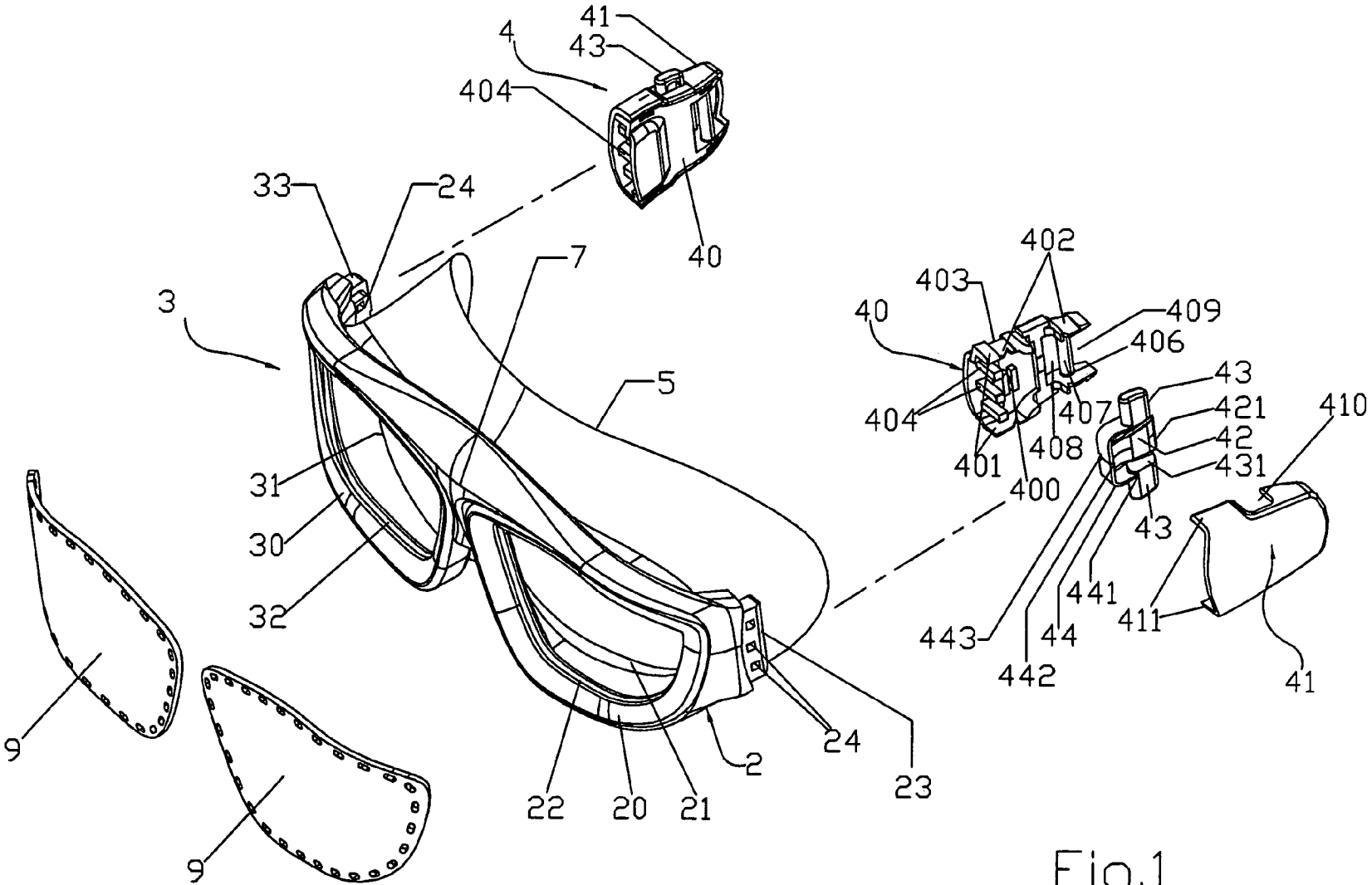
FIG. 1 is an exploded view of swimming goggle of the present invention.
Figure 2:
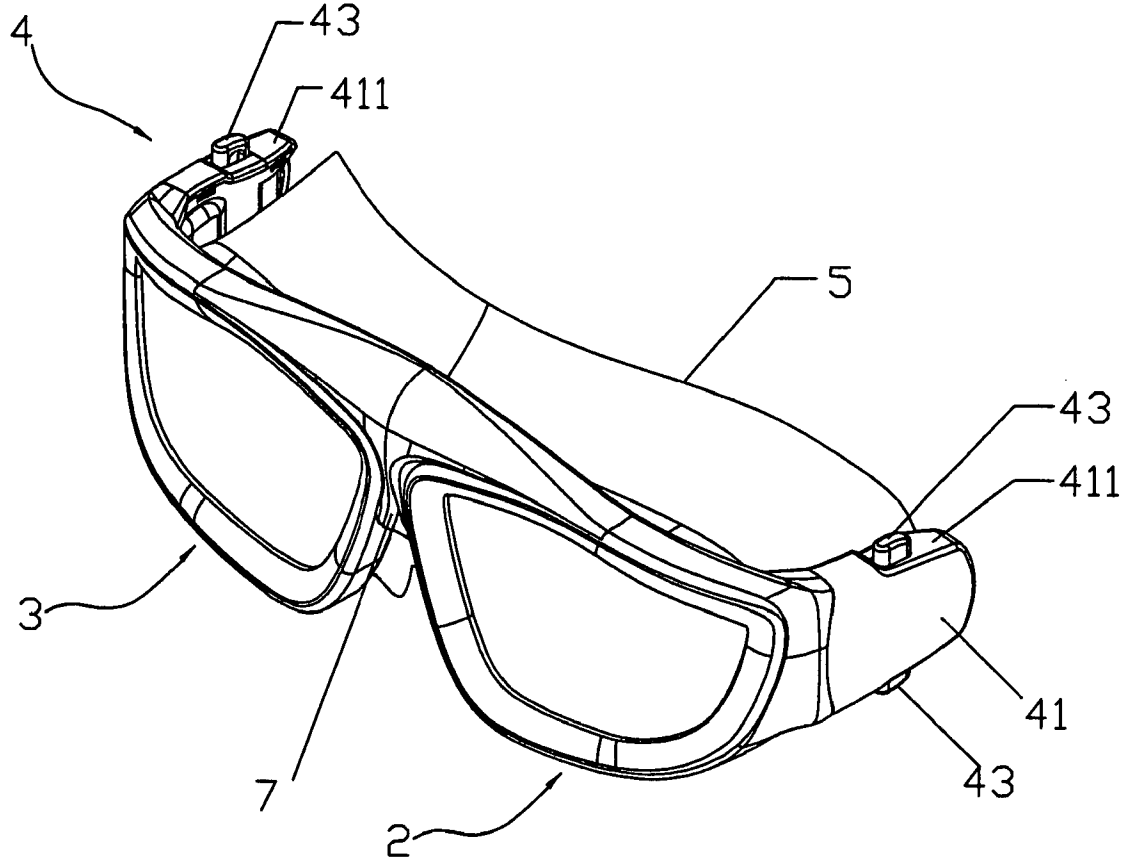
FIG. 2 is an assembled view of the swimming goggle of FIG. 1.
Figure 9:
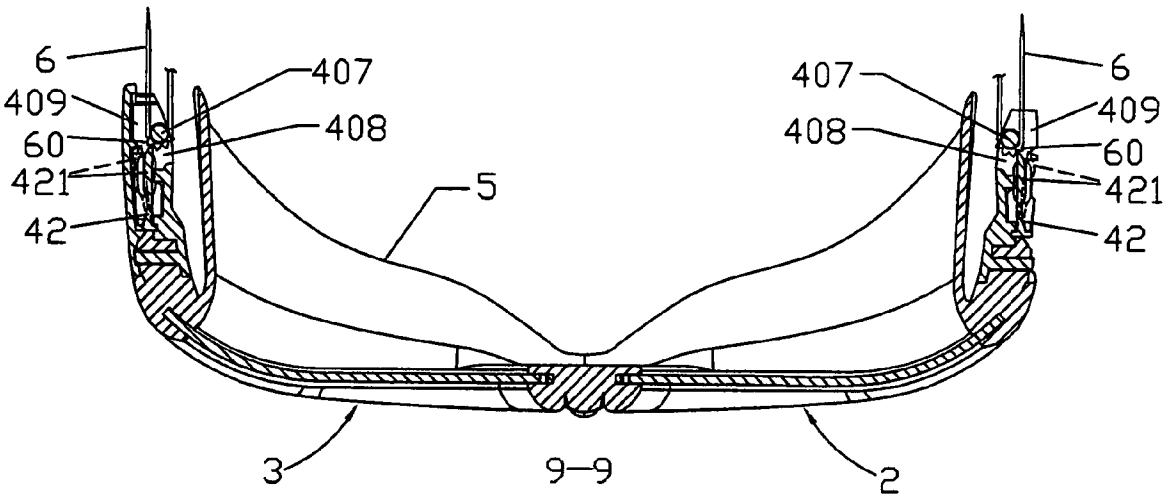
FIG. 9 is a cross-sectional view taken along the line 9—9 in FIG. 8.

With reference to FIGS. 1 and 2, the swimming goggle 1 comprise a left frame 2, a right frame 3, adjusting apparatuses 4 and head fasteners 6 (shown in FIG. 9). A nose support 7 is integrated with the left frame 2 and the right frame 3 and connects the left frame 2 with the right frame 3. In another embodiment a nose support 7 engages with the left frame 2 and the right frame 3 and connects the left frame 2 with the right frame 3.The left frame 2 and the right frame 3 respectively have outer surfaces 20, 30 and inner surfaces 21, 31. Receiving passages 22, 32 are respectively defined between the outer surfaces 20, 30 and the inner surfaces 21, 31 for accommodating eyeglasses 9. A pad 5 is integrated with the inner surfaces 20, 30 of the left and the right frames 2, 3 to provide comfortable touch for a user. In another embodiment pads 5 respectively connect with the inner surfaces 20, 30 of the left and the right frames 2, 3. Engaging portions 23, 33 are respectively formed on outward sides of the left frame 2 and the right frame 3. Each engaging portion 23, 33 define three rectangular receiving holes 24 therein for receiving a corresponding adjusting apparatus 4.

Figure 4:
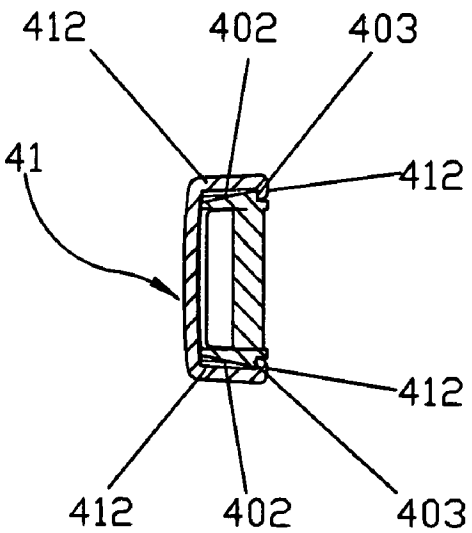
FIG. 4 is a cross-sectional view taken along the line 4—4 in FIG. 3.
Figure 3:
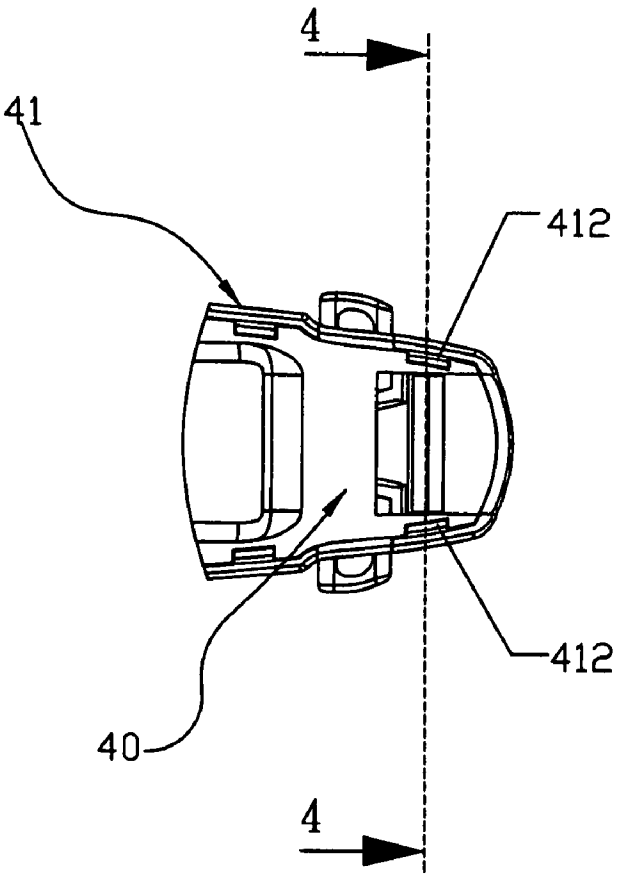
FIG. 3 is a bottom view of an adjusting apparatus of the swimming goggle of FIG. 1, wherein the adjusting apparatus is assembled.
Figure 10:
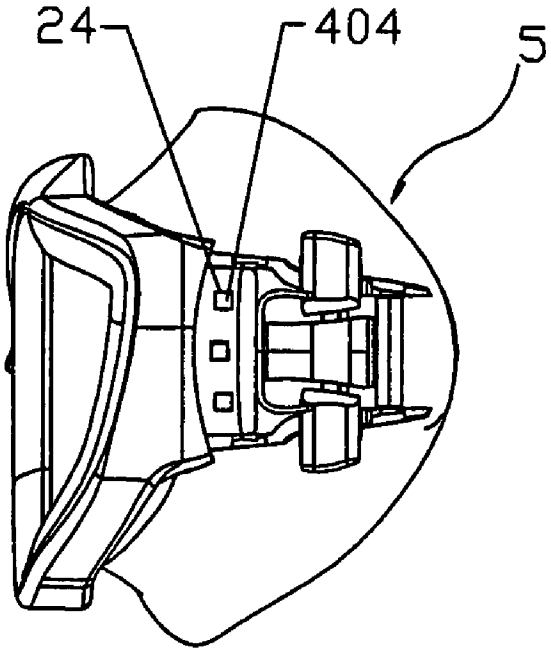
FIG. 10 is a side view of the swimming goggle of FIG. 8.

Each adjusting apparatus 4 comprises a base 40, a cover 41, a biasing arm 42, operating buttons 43 and a flexible arcuate plate 44. Upper and lower sides 401 extend from the base 40, and upper and lower sides 411 extend from the cover 41. Referring to FIGS. 3 and 4, first latches 402 and second latches 412 are respectively formed on the base 40 and the cover 41 for cooperating with each other. The first latches 402 are inclined on the upper and lower sides 401 of the base 40. Cutouts 403 are defined in edges of the first latches 402 and adjacent the base 40. The second latches 412 inwardly extend from the upper and lower sides 411 of the cover 41. The second latches 412 engage with the corresponding cutouts 403 when the cover 41 is assembled to the base 40. Three ribs 404 are formed on the base 40 for locking with the receiving holes 24 of the left frame 2 and the right frame 3 (further referring to FIG. 10). The base 40 defines a shaft hole 406 adjacent to a side thereof for receiving a shaft 407. In combination with FIG. 9, an inlet 408 is defined in the base 40 beside the shaft 407 for guiding a head fastener. The shaft 407 and the cover 41 define an outlet 409 beside the shaft 407 for guiding a head fastener 6 when the cover 41 is assembled on the base 40. The head fastener 6 is pulled from the inlet 408, around the shaft 407 and out of the outlet 409 in assembly. The biasing arm 42, the operating buttons 43 and the flexible arcuate plate 44 are assembled together. The operating buttons 43 are distributed substantially symmetric about the biasing arm 42 for easily controlling the biasing arm 42. The biasing arm 42 has a biasing end 421 at an end thereof for cooperating with the shaft 407 to engage a corresponding engaging slot 60 of a head fastener 6. In assembly the operating buttons 43 are assembled in grooves 410 in the cover 41 and have ends projecting slightly beyond the sides 411 of the cover 41 for convenient performance. Each operating button 43 has an unlocking block 431 at an end thereof and adjacent the biasing arm 42. The unlocking blocks 431 form inclined surfaces for facilitating to drive the biasing arm 42. The flexible arcuate plate 44 has an end 441 connecting with sides of the operating buttons 43, and an opposite side 442 connecting with an end of the biasing arm 42 opposite the biasing end 421 for providing return force. The flexible arcuate plate 44 further defines a positioning hole 443 beside the biasing arm 42 for engaging with a positioning post 400 of the base 40.

Figure 6:
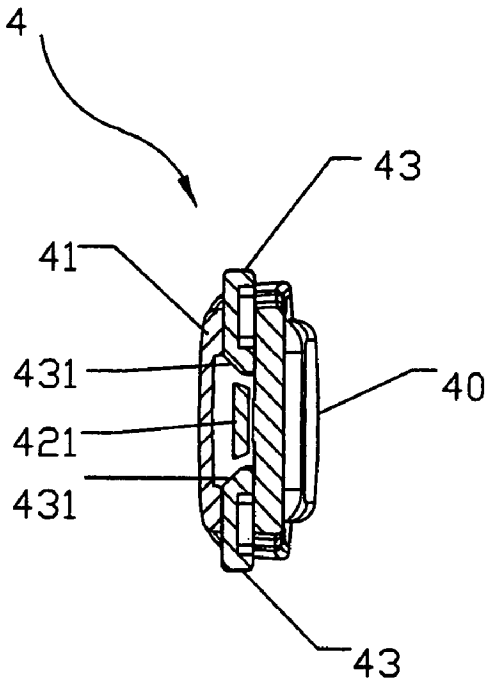
FIG. 6 is a cross-sectional view taken along the line 6—6 in FIG. 5.
Figure 5:
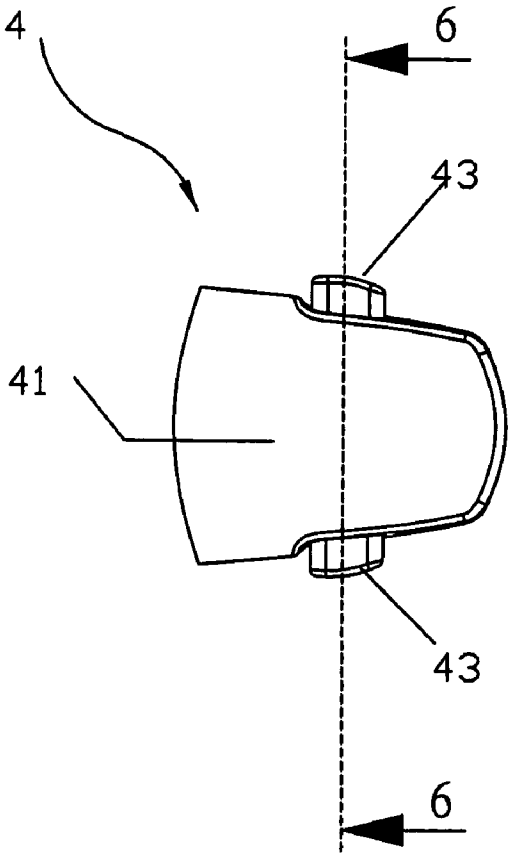
FIG. 5 is a plane view of the swimming goggle of FIG. 3.
Figure 7:
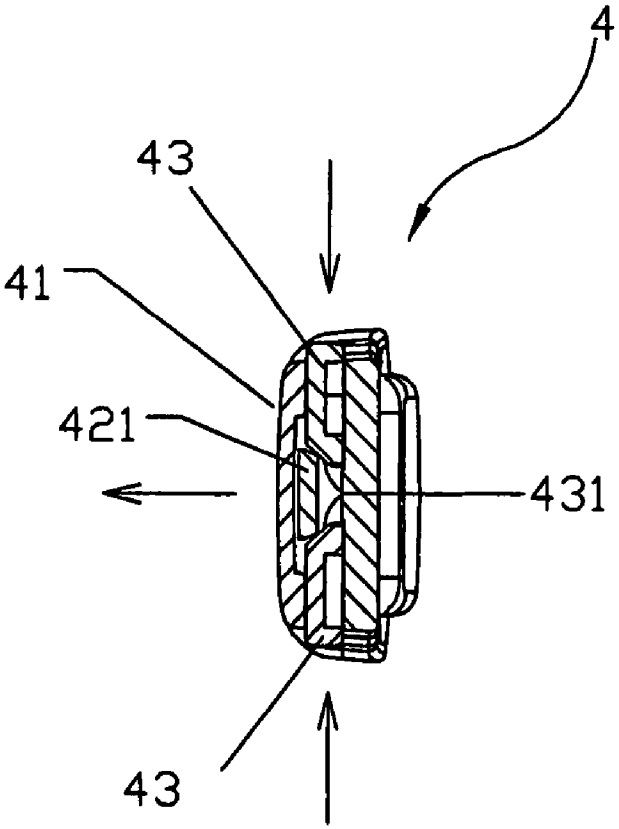
FIG. 7 is similar to FIG. 6, wherein an operating button of the adjusting apparatus is pressed.
Figure 8:
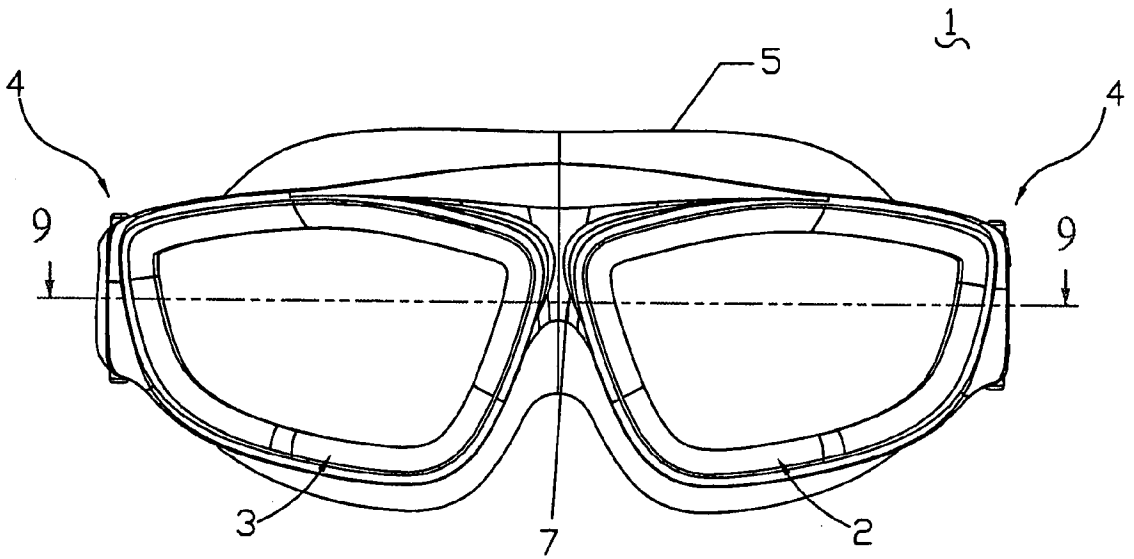
FIG. 8 is a front view of the swimming goggle of FIG. 2, wherein a front cover thereof is removed.

With reference to FIG. 2, in assembly, the adjusting apparatuses 4 are respectively assembled on outward sides of the left frame 2 and the right frame 3. The operating buttons 3 of the adjusting apparatuses 4 project slightly beyond the upper and lower sides 411 of the cover 41. Referring to FIG. 9, each head fastener 6 defines a stopping slot 60 therein. When the operating buttons 43 are free, the head fasteners 6 are shown as dashed line in FIG. 9. The biasing ends 421 of the biasing arms 42 engage the stopping slots 60. The head fasteners 6 cannot move toward the inlets 408, but can only out of the outlets 409. Namely the head fasteners 6 can only move in a single direction. When the operating buttons 43 are pressed, referring to FIGS. 5, 6 and 7, the unlocking blocks 431 of the operating buttons 43 move inwardly so as to drive the biasing ends 421 of the biasing arms 42 to move a certain of distance outward. Consequently, the biasing arms 42 disengage from the shaft 407 to make the head fasteners 6 free. At this time the head fasteners 6 can move freely through the inlets 408 and the outlets 409 for easy adjustment. In use, the head fasteners 6 are preliminary retained with a certain of length. Then the pad 5 of the spectacles is placed properly. The user directly pulls the head fasteners 6 to make it gradually with an appropriate length by operations of the operating buttons 3. Namely, in order to adjust the head fasteners 6, the operating buttons 43 are pressed, meanwhile the head fasteners 6 are pulled toward the inlets 408 for increasing the length of the head fasteners 6.

It is understood that the invention may be embodied in other forms without departing from the spirit thereof. Thus, the present examples and embodiments are to be considered in all respects as illustrative and not restrictive, and the invention is not to be limited to the details given herein.

The invention claimed is:

1. Swimming goggles comprising:

a left frame and a right frame connected together, the left and the right frames respectively having an outer surface and an inner surface, receiving passages being defined between the outer surfaces and inner surfaces of the left and the right frames for accommodating eyeglasses, engaging portions being respectively formed on outward sides of the left frame and the right frame, each engaging portion defining at least one receiving hole therein;

at least one adjusting apparatus assembled to the at least one receiving hole, and each adjusting apparatus including:

a base and a cover respectively having upper and lower sides, first latches formed on the upper and lower sides of the base, and second latches formed on the upper and lower sides of the cover for cooperating with the first latches, ribs being formed on the base for cooperating with the receiving holes of the left frame and the right frame, the base defining a shaft hole adjacent to a side thereof for receiving a shaft, an inlet being defined in the base beside the shaft, the shaft and the cover defining an outlet beside the shaft when the cover is assembled to the base, a biasing arm between the base and the cover, and having a biasing end at an end thereof, operating buttons between the base and the cover, each operating button having an end extending slightly beyond sides of the cover, and an unlocking block at an opposite end and adjacent the biasing arm, and a flexible arcuate plate assembled between the operating button and the biasing arm, said plate having an end connecting with sides of the operating buttons, and an opposite end connecting with an end of the biasing arm opposite to the biasing end for providing return force; and head fasteners assembled from the inlet, around the shaft and out of the outlet, a plurality of stopping slots being defined therein for engaging the biasing ends of the biasing arms;

wherein the biasing arms engage stopping slots of the head fasteners such that the head fasteners move in a single direction when the operating buttons are free; the biasing arms disengage stopping slots of the head fasteners such that the head fasteners move freely through the inlets and the outlets when the operating buttons are pressed.

2. The swimming goggle as claimed in claim 1, wherein the operating buttons are distributed substantially symmetric about the biasing arm for easily controlling the biasing arm.

3. The swimming goggle as claimed in claim 1, wherein the flexible arcuate plates further define positioning holes beside the biasing arms, and the bases further define positioning posts for engaging with the positioning holes.

4. The swimming goggle as claimed in claim 1, wherein a nose support is integrated with the left frame and the right frame and connects the left frame with the right frame.

5. The swimming goggle as claimed in claim 1, wherein a nose support engages with the left frame and the right frame and connects the left frame with the right frame.

6. The swimming goggle as claimed in claim 1, wherein a pad is integrated with the inner surface of the left and the right frames to provide comfort for a user.

7. The swimming goggle as claimed in claim 1, wherein pads respectively connect with the inner surfaces of the left and the right frames.

8. The swimming goggle as claimed in claim 1, wherein the first latches are inclined on the upper and lower sides of the base, and the second latches inwardly extend from the upper and lower sides of the cover, cutouts are defined in edges of the first latches and adjacent the base for engaging with the second latches.

9. The swimming goggle as claimed in claim 1, wherein the unlocking block is positioned at an end thereof and adjacent the biasing arm.

10. The swimming goggle as claimed in claim 1, wherein each of the at least one receiving hole has a rectangular shape for receiving a corresponding one of the at least one adjusting apparatus.

11. The swimming goggle as claimed in claim 1, wherein the unlocking blocks form inclined surfaces for facilitating movement of the biasing arm.

* * * * *